US005382081A

United States Patent [19]

Henry

[11] Patent Number: 5,382,081

[45] Date of Patent: Jan. 17, 1995

[54] FOLDABLE, PORTABLE SEAT STRUCTURE

[76] Inventor: Glen F. Henry, 2628 Willow La., Cedar Falls, Iowa 50613

[21] Appl. No.: 100,251

[22] Filed: Aug. 2, 1993

[51] Int. Cl.[6] ..... A47C 4/00

[52] U.S. Cl. ..... 297/440.12; 206/815

[58] Field of Search ..... 297/440.12, 16.1; 248/174; 206/815; 229/160.2

[56] References Cited

U.S. PATENT DOCUMENTS

| | | | |
|---|---|---|---|
| 2,550,959 | 5/1951 | Bowman | 248/174 X |
| 2,950,039 | 8/1960 | Wilson | 206/815 X |
| 3,727,979 | 4/1973 | Schier et al. | 297/440.12 |
| 4,648,658 | 3/1987 | Calco | 297/440.12 |
| 4,841,882 | 6/1989 | Ehrman | 297/440.12 X |

*Primary Examiner*—Peter R. Brown

*Attorney, Agent, or Firm*—James C. Nemmers

[57] ABSTRACT

A foldable, portable seat structure made from preformed blanks of sheet material such as cardboard. When assembled and folded into a flat position, the seat is easily carried, and the structure has finger holes that facilitate unfolding into a useable seat.

2 Claims, 2 Drawing Sheets

FOLDABLE, PORTABLE SEAT STRUCTURE

BACKGROUND OF THE INVENTION

Portable seat structures have many uses, including use by spectators at sporting events, parades, outdoor concerts, and other events where conventional seating is not readily available. Because the individual who is to use the seat generally must walk to the event, sometimes over a considerable distance, these portable seat structures should be light weight and not bulky. To achieve these objectives, there have been designed such structures which are made from preformed blanks of sheet material such as cardboard. One such structure is disclosed in Schier et al. U.S. Pat. No. 3,727,979. Also, I have marketed a foldable portable seat structure very similar to that shown in the Schier et al. patent.

However, because these structures are collapsible to make them less bulky for carrying, they are folded and unfolded many times during their life. Because of the construction of these seat structures from preformed blanks of cardboard, it is somewhat awkward at times to unfold them when they are to be used. To unfold the seat, the user must grip the top portions which form the seat itself, and frequently these will become bent or damaged, and after a sufficient amount of use the free ends of the original preformed blank may even become separated from each other. There is, therefore, a need for an improved seat structure of this type which facilitates use without damage and therefore, substantially lengthens its useful life.

BRIEF SUMMARY OF THE INVENTION

The invention relates to the type of portable, foldable structure that is manufactured from preformed blanks of sheet material. This sheet material is formed with fold lines and has the free ends of the blank fastened together so that when it is unfolded and bent along the fold lines, the seat structure will have vertical supports and upper portions that flare outwardly in three triangular-shaped corners to form a comfortable seat. The improvement of the invention relates to the formation of finger holes at selected points along the fold lines to make the seat easy to unfold. These finger holes are positioned so as to not weaken the overall structure.

DESCRIPTION OF THE PREFERRED EMBODIMENT OF THE INVENTION

Figure 1:
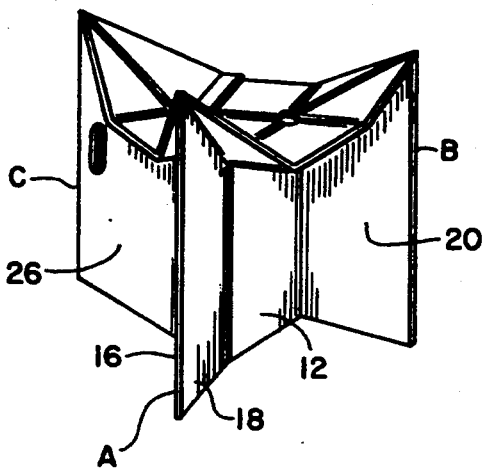
FIG. 1 is a perspective view of a seat structure constructed according to the principles of the invention and showing the seat in the unfolded condition ready for use as a seat.
Figure 2:
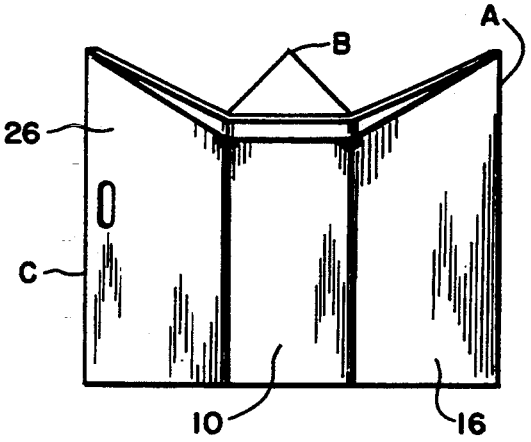
FIG. 2 is a side elevational view of the seat of FIG. 1.
Figure 5:
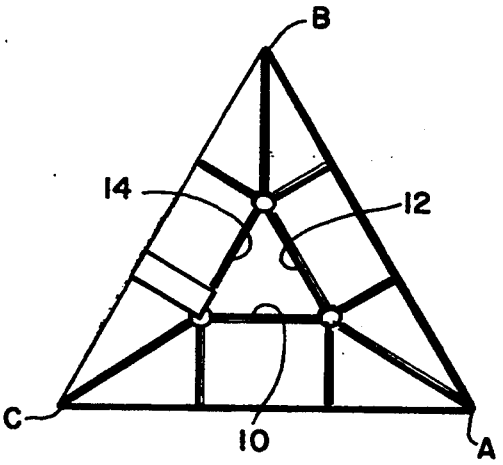
FIG. 5 is a top view of the seat in an unfolded position as shown in FIG. 1.
Figure 6:
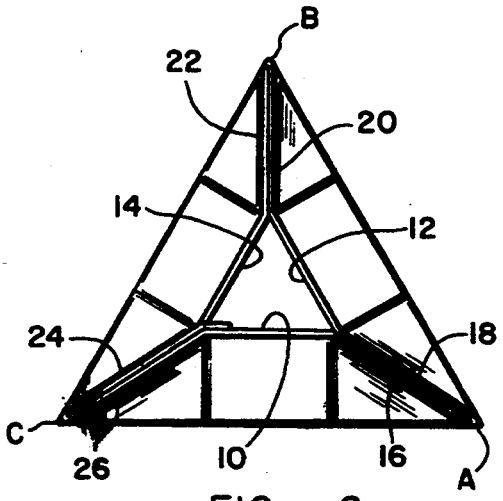
FIG. 6 is a bottom view of the seat of FIGS. 1 and 5.

FIGS. 1 and 2 of the drawings show the portable seat structure of the invention in its assembled and unfolded condition in which it is ready to be used as a seat. The seat structure of the invention is constructed from sheet material, such as cardboard, and as illustrated in FIG. 4, is formed from a rectangular blank of the material having fold lines as described hereinafter.

In its ready-to-use form as shown in FIGS. 1, 2, 5 and 6, the seat structure has three vertical panels 10, 12 and 14 that form a center support section. Extending outwardly from the panels 10 and 12 to form a first corner A are outer panels 16 and 18, and extending outwardly from the panels 12 and 14 to form a corner B are outer panels 20 and 22. Similarly, outer panels 24 and 26 extend outwardly from the inner panels 10 and 14 to form the third corner C.

Figure 4:
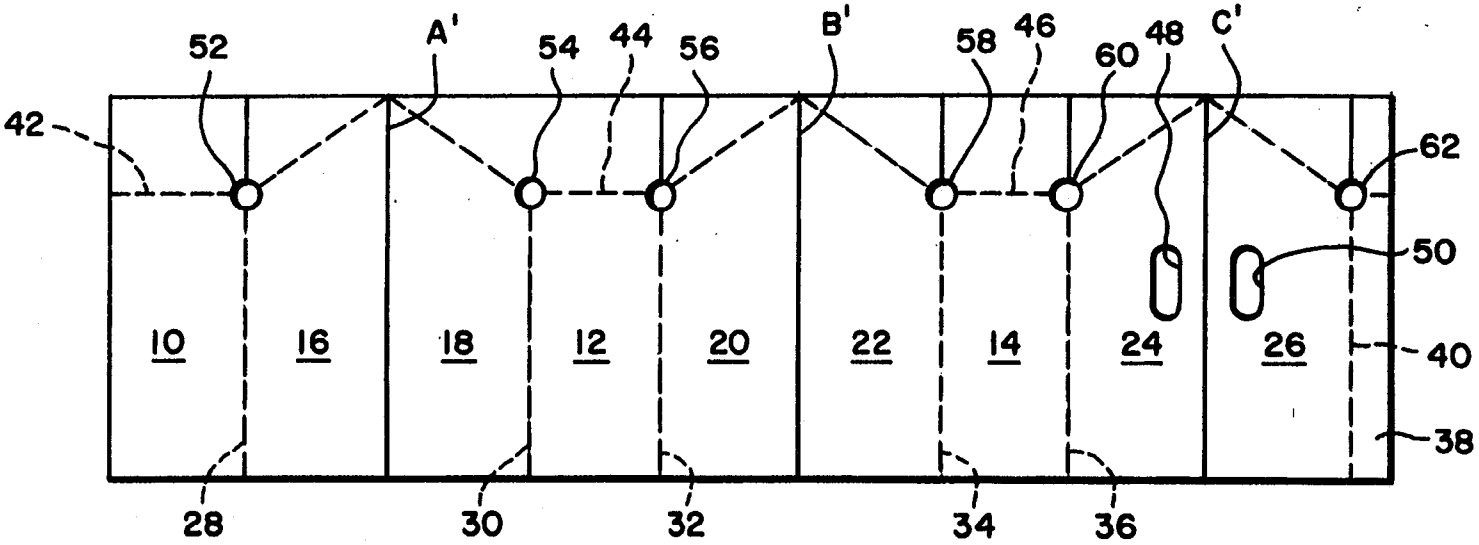
FIG. 4 is a view of a preformed blank showing the fold lines and finger holes.

FIG. 4 shows the rectangular blank of material from which the seat structure of the invention is formed. In FIG. 4, each of the previously described panels is defined by fold lines. These fold lines are preformed in the material by pressing an indentation along the fold line to facilitate folding of the material to form the seat. In FIG. 4, the fold lines between the panels that form the corners A, B and C are indicated by the reference letters A′ B′ and C′. Other fold lines are shown by dotted lines in FIG. 4. A fold line between panels 10 and 16 is designated 28, the fold line between panels 12 and 18 is designated by the reference numeral 30 while the fold line between panels 12 and 20 is designated by the reference numeral 32. Similarly, the fold line between panels 14 and 22 is designated by the reference numeral 34 while the fold line between panels 14 and 24 is designated by reference numeral 36. Along the outer vertical edge of panel 26, there is formed an extra tab 38 which is separated from panel 26 by fold line 40. This tab 38 overlaps panel 10 when the material is fully assembled, and an adhesive is applied along the length of tab 38 to join it to panel 10.

To form the seat portion of the seat structure of the invention, fold lines are also formed along the upper portions of the various panels. As best seen in FIG. 4, some of these fold lines are horizontal while some of the fold lines angle upwardly to the top edge of the blank of material. As shown in FIG. 4, the fold line 42 in the upper portion of panel 10 extends horizontally as does the fold line 44 in panel 12 and the fold line 46 in panel 14. However, the fold lines in the panels that form the corners A, B and C are at an angle as shown in FIG. 4. These fold lines extend along the upper portions of panels 16, 18, 20, 22, 24 and 26.

Figure 3:
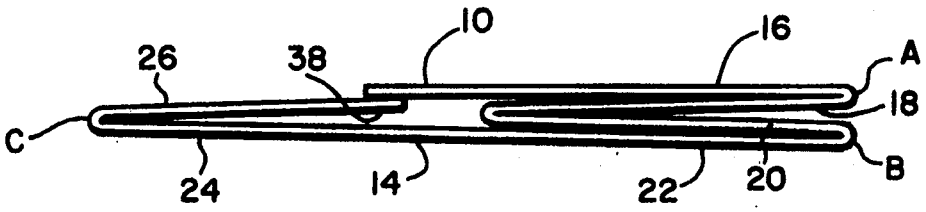
FIG. 3 is a top view of the seat in a folded condition for carrying.

To assemble the rectangular blank of materials into a seat structure of the invention, the preformed blank of material with the preformed fold lines is folded along the fold lines A′, B′ and C′ into a folded structure with the tab 38 overlapping the edge of panel 10. The tab 38 is then glued to the surface of panel 10. At this point, the seat structure is fully assembled and in a flattened conditioned as illustrated in FIG. 3. In this folded and flattened condition, the seat can be easily carried, and to facilitate carrying, hand holes 48 and 50 are formed in the panels 24 and 26 respectively.

When it is desired to use the seat structure, it is placed on its lower edge, and the upper portions of the panels are then folded outwardly to form the seat structure. With prior art seats of this type, the user first separates the panels that form the corners A and B, and while holding these panels apart, the upper portions of the panels are folded along the fold lines to form the seat. When the structure is in the flattened condition of FIG. 3, this is frequently somewhat difficult to do, and with repeated use, the upper portions of the various panels can become deformed and even torn. I have therefore provided finger holes at selected places along the fold lines to facilitate the unfolding of the structure into a useable seat. As best seen in FIG. 4, a finger hole 52 is provided along the fold line 28 where it joins the upper fold lines, a finger hole 54 is provided along fold line 30 and a finger hole 56 is provided along fold line 32. Similarly, finger holes 58, 60 and 62 are provided along fold lines 34, 36 and 40 respectively. With these finger holes, the user merely inserts his or her finger into one or more of the finger holes and pulls the panels outwardly and downwardly. This makes the seat structure much easier to unfold and minimizes any damage to the panels through repeated use.

Having thus described the invention in connection with the preferred embodiment thereof, it would be evident to those skilled in the art that various revisions and modifications can be made to the embodiment described herein without departing from the spirit and scope of the invention. It is my intention, however, that all such revisions and modifications that are obvious to those skilled in the art will be included within the scope of the following claims:

What is claimed is:

1. A portable seat that can be repeatedly folded into a substantially flat structure for carrying and into a stable seat structure when used as a seat, said portable seat comprising a rectangular-shaped blank of heavy cardboard material and having an upper edge, a lower edge and two end edges, a plurality of vertical fold lines formed at spaced intervals between said end edges and extending upwardly from the bottom edge toward the top edge to form panels between said vertical fold lines, means joining the end edges when the blank is folded along three of the vertical fold lines that are spaced apart from each other to form a unified substantially flat structure when not in use as a seat, horizontal fold lines along some of said panels between the said three of the vertical fold lines so as to form inner support sections, the other of the panels extending outwardly from the inner support sections to the said three vertical fold lines to form three triangular corners of the seat, angled fold lines extending from the horizontal fold lines above the inner support sections to the upper edge of the blank and terminating at triangular corners, the areas above the horizontal fold lines and the angled fold lines forming upper sections in each of all the panels which horizontal and angled fold lines provide for the upper sections to be folded outwardly by the user to form the seat structure with the inner support sections forming the base for the seat structure, said upper sections being foldable inwardly by the user to return the structure to its substantially flat condition for ease of portability, and finger openings formed at the juncture of the horizontal fold lines with the angled fold lines and those of the vertical fold lines that define the inner support sections, said finger openings providing for the easy folding of the upper sections outwardly to form the seat.

2. The foldable, portable seat structure of claim 1 in which two of the panels forming one of the corners are provided with hand holes that provide for carrying of the seat structure in its folded substantially flat condition.

* * * * *